United States Patent [19]

Czerwinski

[11] 4,197,547

[45] Apr. 8, 1980

[54] HIGH FREQUENCY AIRCRAFT WIRE ANTENNA

[75] Inventor: Watson P. Czerwinski, Forked River, N.J.

[73] Assignee: The United States of America as represented by the Secretary of the Army, Washington, D.C.

[21] Appl. No.: 919,114

[22] Filed: Jun. 26, 1978

[51] Int. Cl.[2] ..... H01Q 1/28

[52] U.S. Cl. ..... 343/708; 343/752

[58] Field of Search ..... 343/705, 707, 708, 750, 343/752, 845, 846

[56] References Cited

U.S. PATENT DOCUMENTS

| | | | |
|---|---|---|---|
| 2,044,779 | 6/1936 | Hanson | 343/708 |
| 2,279,130 | 4/1942 | Bruce | 343/712 |
| 2,756,423 | 7/1956 | Dylewski | 343/829 |
| 3,151,327 | 9/1964 | Levy et al. | 343/705 |
| 3,172,110 | 3/1965 | Zieg | 343/708 |
| 3,936,834 | 2/1976 | Vallese et al. | 343/830 |

OTHER PUBLICATIONS

Cincinnati Electronics, Model AA-20HF Tranline ® Antenna.

*Primary Examiner*—Eli Lieberman

*Attorney, Agent, or Firm*—Nathan Edelberg; Sheldon Kanars; Edward Goldberg

[57] ABSTRACT

What is disclosed is an antenna system for aircraft and one having particular utilization on a helicopter where there is a need, among other things, to eliminate insofar as possible rotor blade modulation of the signal radiated from on-board air-to-ground communication system in the 2 to 30 MHz band. The antenna comprises a current fed grounded loop-antenna having an electrical length which is relatively short with respect to the operating wavelength. The antenna conductor is mounted by means of insulators on the outside of the aircraft body, having one end connected to the transmitter while the other end is series connected to a lumped electrical inductance element whose opposite end is terminated in the metallic skin of the aircraft. The electrical inductance, moreover, is variable so as to resonate the antenna to the driving impedance of the transmitter.

6 Claims, 4 Drawing Figures

HIGH FREQUENCY AIRCRAFT WIRE ANTENNA

The invention described herein may be manufactured and used by the Government for governmental purposes without the payment of any royalties thereon or therefor.

BACKGROUND OF THE INVENTION

This invention relates generally to radiators of electromagnetic energy and more particularly to loop antennas which utilize a portion of the support structure for a return path for RF current.

Wire antennas for use on military aircraft for air-to-ground communications in the 2 to 30 MHz band is known. Because of limited space the electric length of the conductor of such antennas is only a small fraction of a wavelength. In order to transform the high input impedance of its relatively short length wire to a nominal value of, for example 50 ohms a tuning unit consisting of one or more capacitors is required to be connected between the wire and the radio apparatus. The zig-zag wire antenna currently in use on helicopters is representative of this type of antenna system. The zig-zag configuration is intended to lower the impedance at the input end of the wire in order to reduce the losses in the tuning unit. The electrical performance of this configuration, however, is compromised by the added shunt capacitance between the wire and the aircraft body.

One known attempt to overcome this problem has been disclosed by Cincinnati Electronics in its Model AA-20HF train line antenna which comprises a radiator directly connected at its far end to the aircraft body.

SUMMARY

Briefly, the subject invention is directed to improved aircraft antenna for operation in the HF frequency range (2–30 MHz) comprising an antenna conductor of predetermined short length with respect to the operating wavelength, mounted on the outside either above or below the aircraft by means of dielectric supports. One end of the loop antenna conductor is coupled inside the aircraft to its associated radio apparatus in the forward portion of the aircraft while the opposite end is series connected to a lumped electrical inductance of predetermined value which has its remote end connected to the metallic skin of the aft portion of the aircraft. The metallic skin acts as the return path for the RF current. The lumped inductance, furthermore, includes means for having its inductance value selectively varied in order to substantially series resonate the antenna at its particular operating frequency with capacitance of the feedpoint.

DESCRIPTION OF THE PREFERRED EMBODIMENTS

Figure 1:
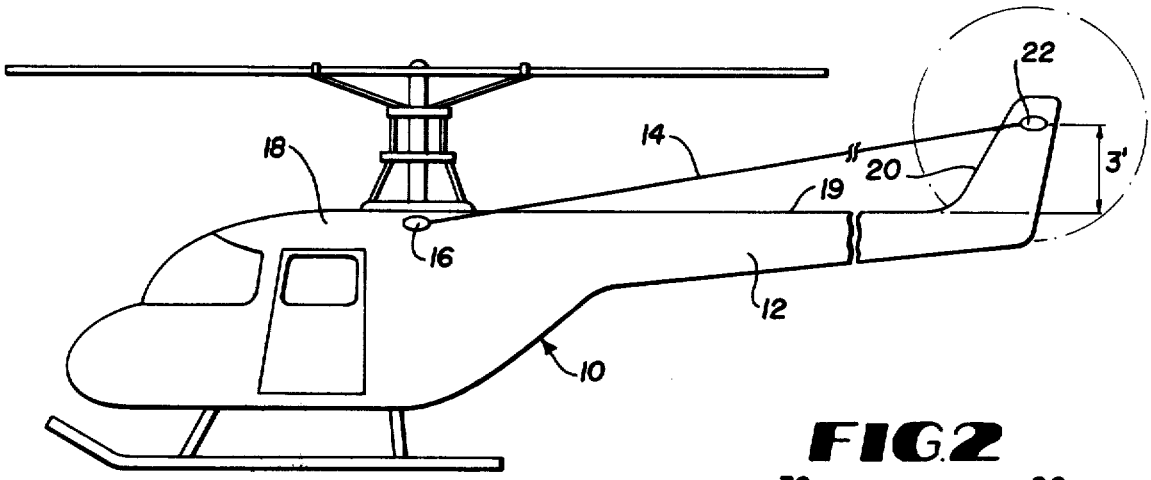
FIG. 1 is a side elevational view of a helicopter type aircraft including the subject invention.

Referring now to the drawings, and more particularly to FIG. 1, reference numeral 10 designates a helicopter type of aircraft having a metallic outer surface or skin 12. A wire conductor antenna element 14 extends from a feedthrough insulator and 18 inch stand-off assembly 16 located on the fuselage section 18 for coupling to radio communications apparatus, not shown, located inside the aircraft and being operable in the 2 to 30 MHz frequency band. The wire antenna 14 is of a predetermined length typically 15 feet, and is shown in FIG. 1 extending the length of the tail section 19 to the vertical stabilizer section 20. The end of the conductor wire 14 at the stabilizer end couples to an inductance assembly 22 which is located typically 3 feet up on the stabilizer section. The inductance assembly is shown schematically in FIG. 2. While the wire loop antenna 14 extends a substantial portion of the total length of the helicopter type of aircraft 10, the electrical length of the antenna 14 is nevertheless still only a small fraction of the operational wavelength of the HF frequency band of the radio communications apparatus inside the fuselage 18.

Figure 2:
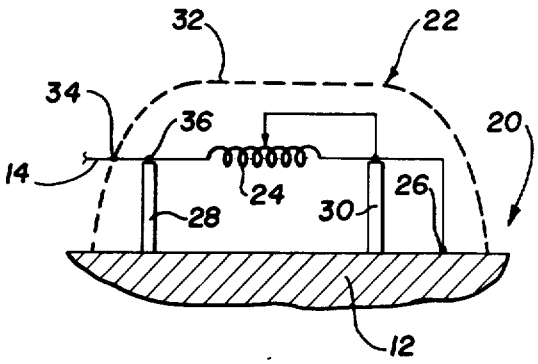
FIG. 2 is an electrical schematic diagram directed to the improvement taught by the subject invention.

Referring now to FIG. 2, the antenna conductor 14 series connects to a variable inductor 24 which has its other end connected to the metallic skin 12 of the aircraft which is shown in FIG. 2 by the connection 26. The inductor 24 comprises a variable lumped inductor element which, except for its ground connection to the surface of the aircraft via the metal skin 12, is mounted for example on a pair of insulator stand-off elements 28 and 30 secured to the skin of the aircraft 12. In order to protect the inductor element 24, reference numeral 32 is intended to designate an aerodynamic radome or a protective cover of any desired type including an electrical feedthrough 34 which permits the wire antenna 14 to couple to the inductor 24 at the connection 36. Whereas in prior art antenna systems of the type disclosed the antenna terminates directly in the skin of the aircraft, the inclusion of the series inductance 24 at the grounded end of the antenna provides operational results heretofore unobtainable in a loop type of antenna where the metallic skin of the aircraft provides the return path for the RF current.

Figure 3:
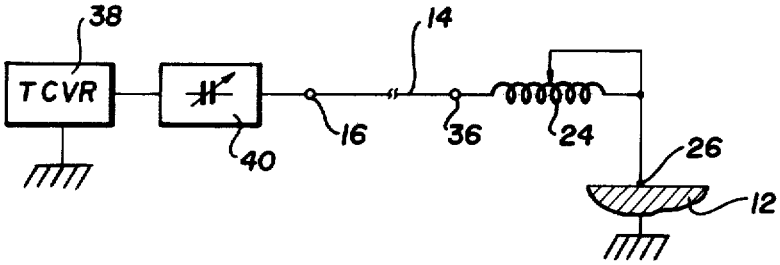
FIG. 3 is an electrical schematic diagram illustrative of one form of the subject invention.

As shown schematically in FIG. 3, the wire antenna and the series inductor 24 are coupled to radio communications apparatus such as a transceiver 38 by means of a matching network 40 consisting of one or more RF capacitors used for transforming the relatively high input inpedance of the electrically short wire to the output impedance, nominally 50 ohms, of the transceiver apparatus 38. By the inclusion of the series inductance 24 a near series resonance condition is achievable by selective variation of the inductance value and accordingly the inductive reactance. Since the antenna conductor wire 14 is of itself a small inductance, the lumped inductance 24 is the primary element which series resonates with the tuning capacitor for the matching network 40 and any distributed capacitance. Ordinarily when the far end of the antenna is grounded as in the prior art, an extremely high voltage exists at the feed end of the antenna; however, the near resonance condition achieved by the inductance 24 substantially reduces the RF voltage at the feed end of the antenna, consequently, a tuning capacitor with a lower voltage rating can be used. In substance, the wire loop antenna 14 becomes current fed with the resulting advantage that the power handling capability is measurably increased.

Figure 4:
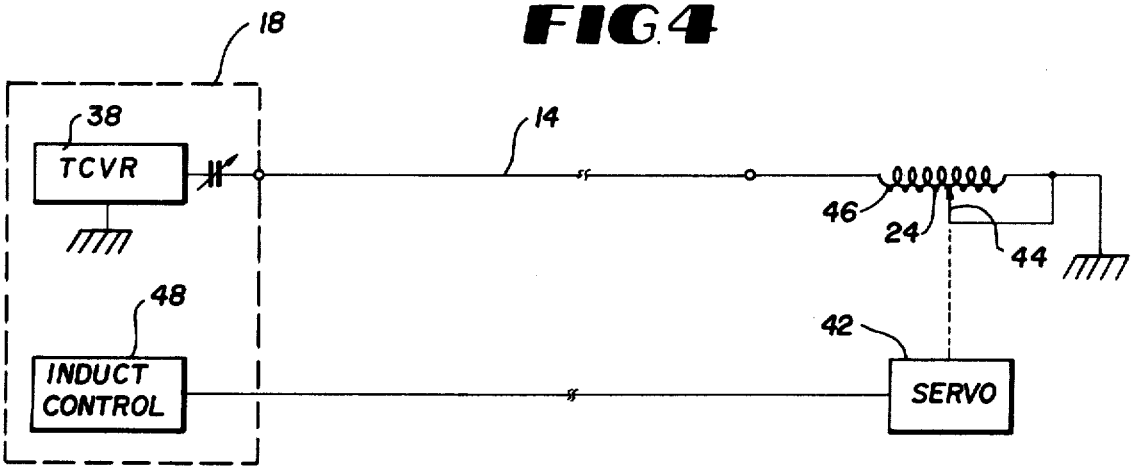
FIG. 4 is an electrical schematic diagram illustrative of a second form of the subject invention.

Since the value of the inductance 24 must be selected in accordance with the operating frequency of the transceiver for optimum operation, FIG. 4 is intended to show that, when desirable, the inductance 24 may be remotely controlled by means of an electrical mechanical servo-subsystem 42 coupled to the movable contact 44, which is adapted to be moved to one of the multiple taps 46 on the inductor. By means of the control circuitry being located in the vicinity of the transceiver apparatus 38, the operator can selectively vary the inductor 24 through the servo-subsystem and accordingly fine tune the antenna for each operating frequency over the 2–30 MHz band which is particularly adapted for military aircraft communications.

Thus what has been shown is an improved HF antenna for aircraft which is adapted to minimize the distributed shunt capacitance of the antenna wire due to its separation away from the aircraft body while at the same time providing a low input impedance at the feed-point end in order to reduce tuner losses. Stored-energy losses are also reduced providing an increase in efficiency at the low end of the frequency band. The reduced stored-energy losses accordingly lower the Q of the antenna which is accompanied by an increase in bandwidth. The resulting low impedance and lower Q of the antenna consequently reduce the amplitude modulation effect produced by the primary rotor blades of a helicopter. When desirable, the same type of antenna however can be configured on a fixed wing aircraft with minor modifications well known to those skilled in the art.

Accordingly, I claim as my invention:

1. A high frequency antenna system for aircraft radio communication apparatus comprising in combination:

an aircraft body having an electrically conductive outer surface;

an elongated straight wire conductor antenna having an electrical length which is short relative to the operating wavelength, said antenna wire being mounted externally above said outer surface and being electrically insulated therefrom along its length;

a capacitive matching network coupled between said radio communication apparatus and one end of said antenna wire; and a lumped electrical inductance of selectively variable value connected in series at one end to the opposite end of said length of antenna wire and directly and continuously connected at the other end to said conductive outer surface, said selectively variable inductance being in series resonance with said capacitive network and antenna wire at the operating frequency of said antenna to provide a relatively low impedance and low voltage at the output of said radio communication apparatus, said outer surface forming a continuous return path to said radio apparatus for RF current, said antenna system providing a current fed grounded loop antenna.

2. The antenna system as defined by claim 1 wherein said inductance is mounted externally above said outer surface and including a protective housing enclosing said inductance.

3. The antenna system as defined by claim 1 wherein said radio communications apparatus is located in the forward portion of said aircraft body and wherein said inductance is located at the rearward portion of said aircraft body.

4. The system as defined by claim 3 and additionally including a protective housing located on the outer surface of said aircraft body, said housing including therein said electrical inductance, and insulating means for mounting said inductance above said outer surface.

5. The system as defined by claim 3 wherein said aircraft body includes a fuselage section, a tail section and a stabilizer section projecting upwardly from said tail section and wherein said length of antenna wire extends between said fuselage section and said stabilizer section.

6. The antenna system as defined by claim 5 and additionally including a protective housing located a predetermined distance above from said tail section on said stabilizer section and including said electrical inductance in said housing.

* * * * *